US005676166A

United States Patent [19]

Chang

[11] Patent Number: 5,676,166

[45] Date of Patent: Oct. 14, 1997

[54] HAIR CLIP

[76] Inventor: Wen-Shyong Chang, No. 7, Alley 116, Lane 175, Sec. 1, Ta Tung Road, Tainan City, Taiwan

[21] Appl. No.: 712,447

[22] Filed: Sep. 11, 1996

[51] Int. Cl.[6] ..... A45D 8/30

[52] U.S. Cl. ..... 132/279; 132/133

[58] Field of Search ..... 132/133, 132, 132/279, 278, 138, 275, 276

[56] References Cited

U.S. PATENT DOCUMENTS

| | | | |
|---|---|---|---|
| 573,887 | 12/1896 | Kraus | 132/133 |
| 717,499 | 12/1902 | Gouy | 132/273 |
| 1,015,802 | 1/1912 | Judis | 132/278 |
| 1,596,737 | 8/1926 | Johnson | 132/133 |
| 2,159,709 | 5/1939 | Quetin | 132/133 |
| 2,594,230 | 4/1952 | Solomon et al. | 132/279 |
| 2,718,894 | 9/1955 | Gresham et al. | 132/133 |
| 2,902,042 | 9/1959 | Halber | 132/279 |
| 2,998,015 | 8/1961 | Gresham et al. | 132/279 |
| 3,998,233 | 12/1976 | Dorr | 132/279 |

FOREIGN PATENT DOCUMENTS

| | | | |
|---|---|---|---|
| 342830 | 9/1904 | France | 132/133 |
| 9516 | 5/1899 | United Kingdom | 132/133 |
| 800390 | 8/1958 | United Kingdom | 132/276 |

*Primary Examiner*—Paul J. Hirsch
*Attorney, Agent, or Firm*—Charles E. Baxley, Esq.

[57] ABSTRACT

A hair clip includes a first clip piece and a second clip piece which are complimentarily formed. Each of the first and second clip pieces includes an inclined teeth-like clipping portion formed at a bottom thereof, each inclined clipping portion including a plurality of teeth which are so spaced and dimensioned as to allow smooth lateral opening and closing of the two clipping portions without jamming between the teeth of the clipping portions. The second clip piece has a first end pivotally connected to a first end of the first clip piece. The first clip piece and the second clip piece respectively have a clipping end formed on a second end thereof, the two clipping ends extending in different directions so as to be releasably engaged together.

2 Claims, 5 Drawing Sheets

HAIR CLIP

BACKGROUND OF THE INVENTION

1. Field of the Invention

The present invention relates to an improved hair clip which can be opened at a larger angle than conventional hair clips to clip hair.

2. Description of the Related Art

Long-haired women often use hair clips to clip and decorate their hair. A typical hair clip is shown in FIG. 5 of the drawings. The hair clip consists of two clip pieces 4 each having a teeth-like inclined clipping portion 41 formed at a bottom thereof. Each clip piece 4 further includes two ears 42 formed at an upper portion of a side thereof, each ear 42 having a bore 43 defined therethrough. In assembly, the ears 42 of one of the clip pieces 4 are placed adjacent to the ears 42 of the other clip piece 4, and a pin 5 is then inserted through the bores 43 in the ears 42. A torsion spring 6 is mounted between two inner ears 42 and around the pin 5. In use, the user may press at two press portions 44 respectively formed on the upper ends of the clip pieces 4, which causes the clip pieces 4 to open outwardly for clipping hair.

One of the clipping portions 41 includes inclined teeth which alternatively engage with inclined teeth on the other clipping portion 41 to achieve the required clipping effect. The hair may be wound around and then secured at the upper neck, which is convenient in work, showering, etc. In addition, the clipped hair may present three-dimensional esthetics.

A drawback of the above-mentioned conventional design is that the opening angle of the two clip portions 41 is limited as the press portions 44 contact with each other and thus impede further opening of the clip portions 41. In addition, the press portions 44 are exposed when in use, which results in an unesthetic outlook. Furthermore, the life of the hair clip terminates as the torsion spring 6 malfunctions due to elasticity fatigue.

Therefore, there has been a long and unfulfilled need for an improved hair clip which mitigates and/or obviates the above drawbacks.

SUMMARY OF THE INVENTION

A hair clip in accordance with the present invention includes a first clip piece and a second clip piece which are complimentarily formed. Each of the first and second clip pieces includes an inclined teeth-like clipping portion formed at a bottom thereof, each inclined clipping portion including a plurality of teeth which are so spaced and dimensioned as to allow smooth lateral opening and closing of the two clipping portions without jamming between the teeth of the clipping portions. The second clip piece has a first end pivotally connected to a first end of the first clip piece. The first clip piece and the second clip piece respectively have a clipping end formed on a second end thereof, the two clipping ends extending in different directions so as to be releasably engaged together.

Preferably, each the first and second clip pieces includes a decoration portion which is exposed when the hair clip is used on a hair of a user.

Other objects, advantages, and novel features of the invention will become more apparent from the following detailed description when taken in conjunction with the accompanying drawings.

DESCRIPTION OF THE PREFERRED EMBODIMENT

Figure 1:
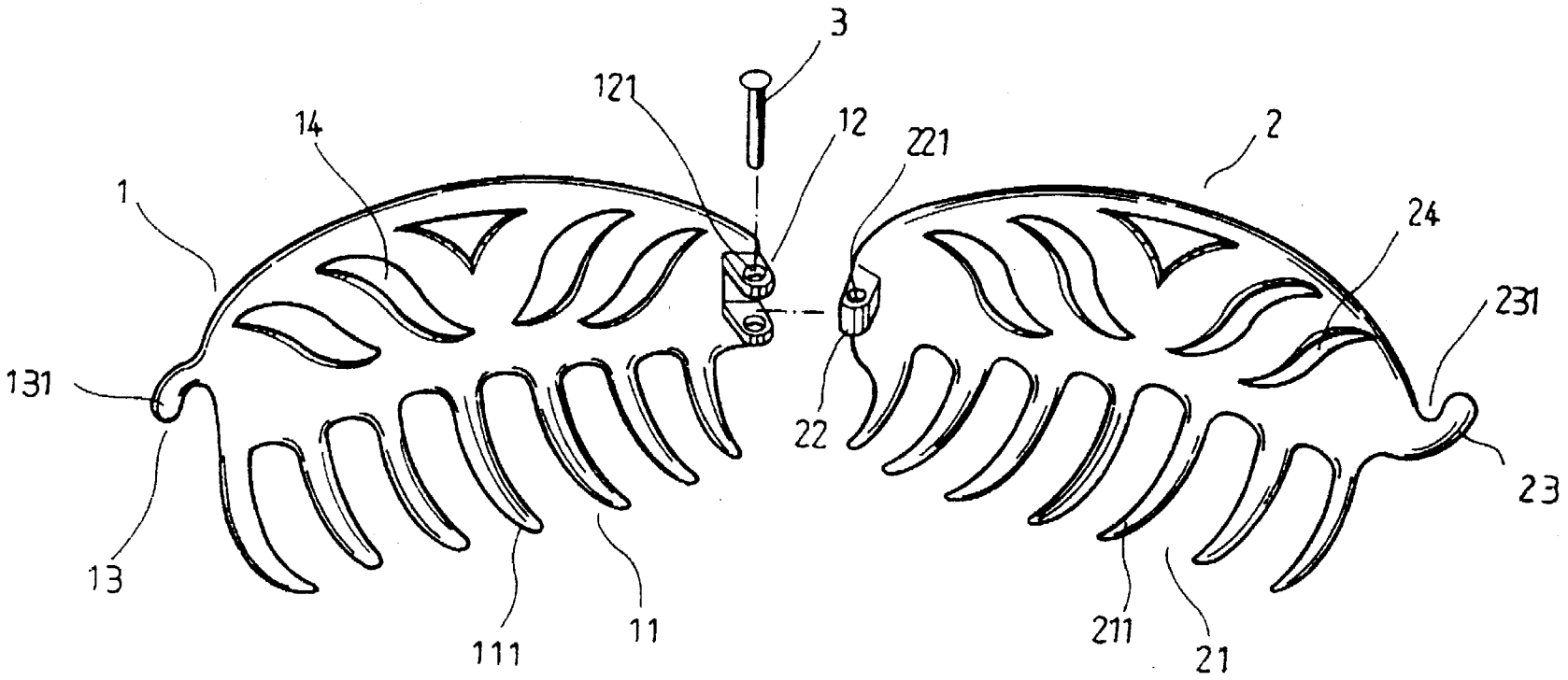
FIG. 1 is an exploded perspective view of a hair clip in accordance with the present invention.
Figure 2:
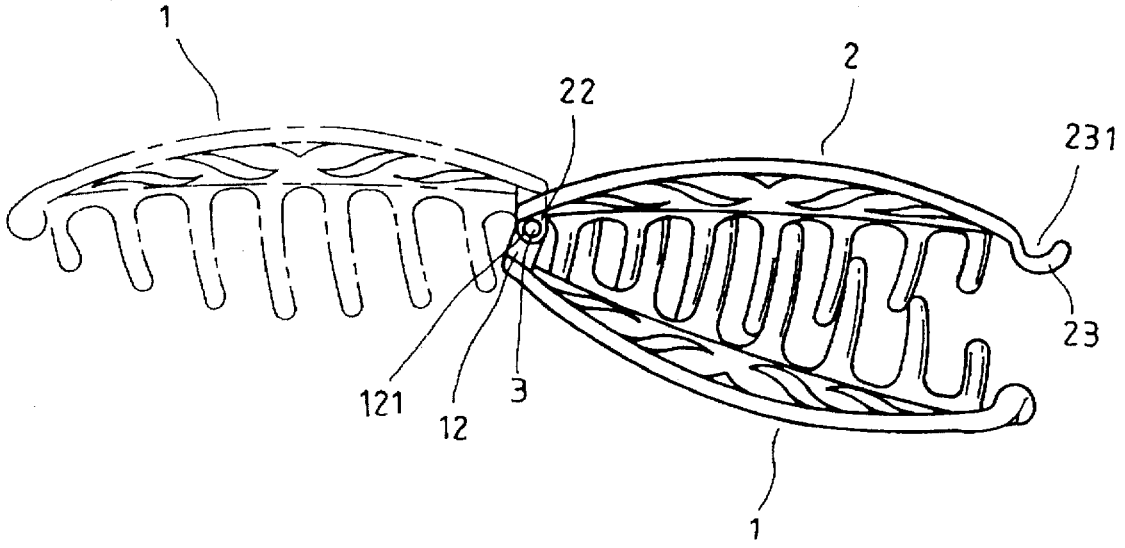
FIG. 2 is a side elevational view illustrating operation of the hair clip of the present invention.
Figure 3:
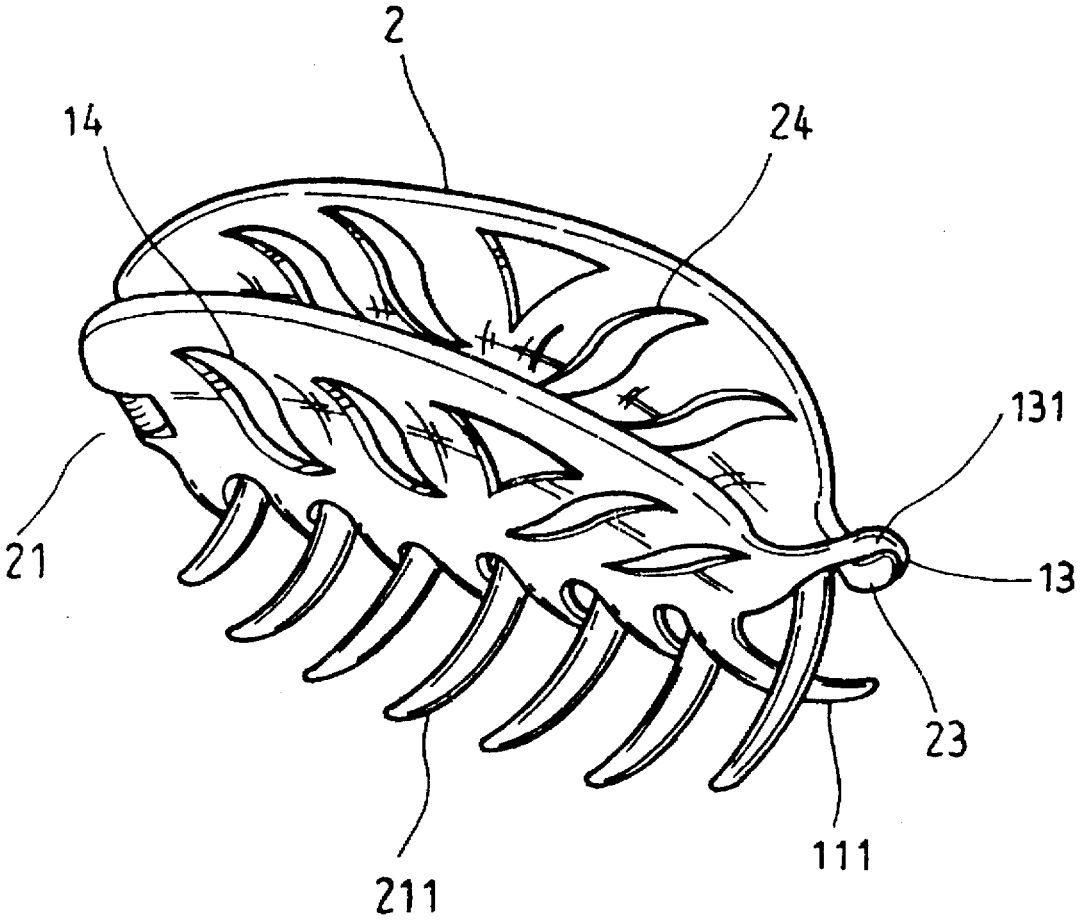
FIG. 3 is a perspective view of the hair clip of the present invention.

Referring to FIGS. 1 to 4 of the drawings and initially to FIGS. 1 to 3, a hair clip in accordance with the present invention generally includes a first clip piece 1 and a second clip piece 2 which are made from flexible material. The first clip piece 1 and the second clip piece 2 are complimentarily formed and both have an inclined teeth-like clipping portion 11, 21 formed at a bottom thereof. The inclined clipping portion 11, 21 includes a plurality of teeth 111, 211 which are properly spaced and include a certain length, such that the two clipping portions 11 and 21 may be smoothly opened or closed laterally without jamming between the teeth of the clipping portions 11 and 21.

The first clip piece 1 and the second clip piece 2 are hinged together, e.g., two bored ears 12 (see the bore 121 in each ear 12) are formed on a first end of the first clip piece 1, and a bored lug 22 is formed on a first end of the second clip piece 2 (see the bore 221 in the lug 22). Thus, the first clip piece 1 and the second clip 2 can be hinged together by a pin 3 extending through the associated bores defined in the ears 12 and the lug 22. In addition, the first clip piece 1 may include a first clip member 13 with a first clipping end 131 formed on a second end thereof, while the second clip piece 2 may include a second clip member 23 with a second clipping end 231 formed on a second end thereof. The first clipping end 131 and the second clipping end 231 extend in different directions so as to be releasably engaged together. The first clip piece 1 and the second clip piece 2 may further include decoration portions 14 and 24 to increase the aesthetic of the hair.

Figure 4:
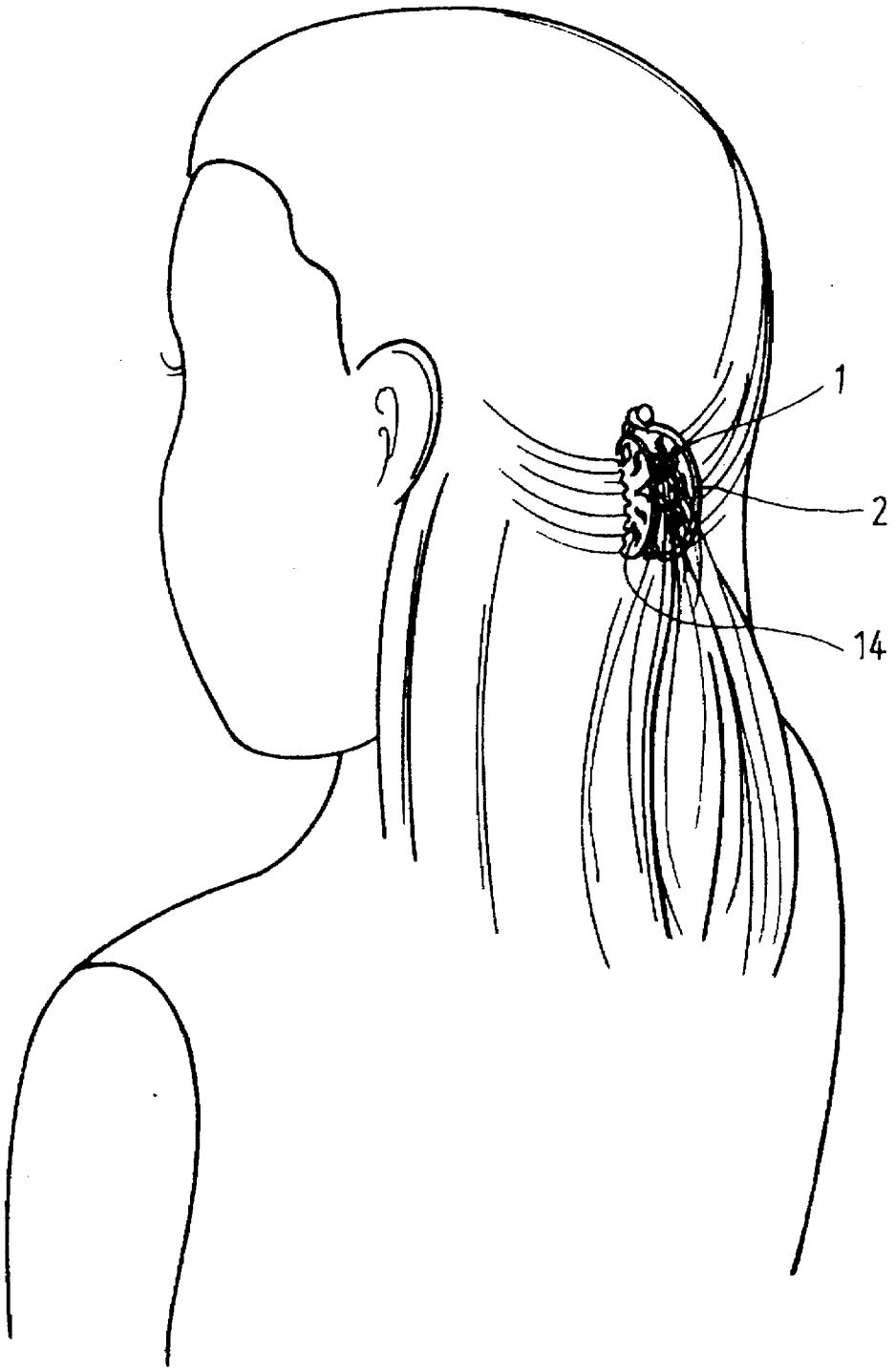
FIG. 4 is a perspective view illustrating usage of the hair clip.
Figure 5:
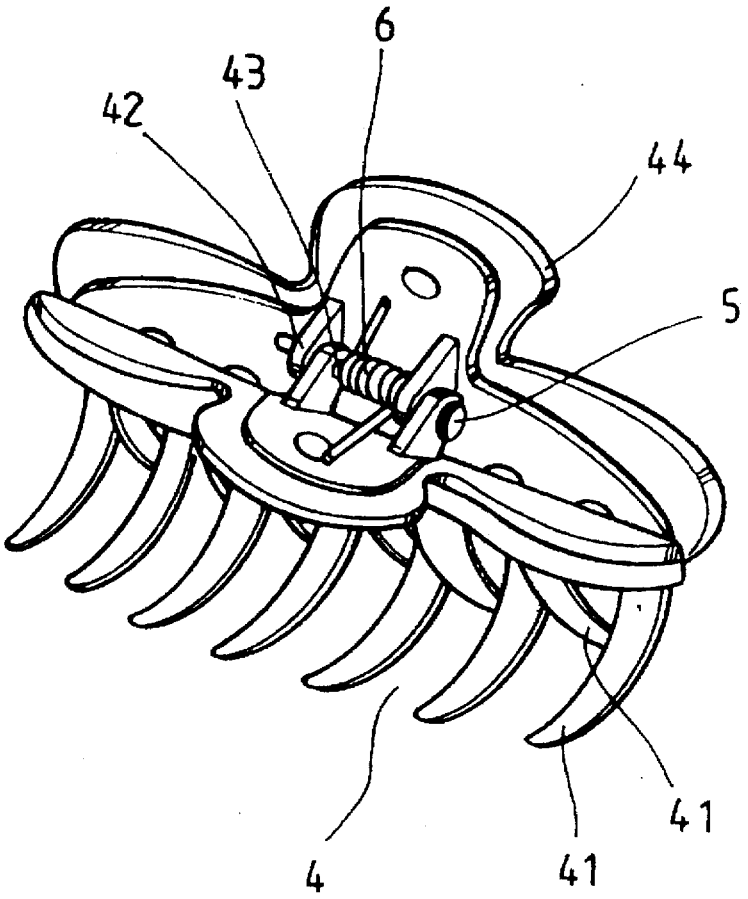
FIG. 5 PRIOR ART
FIG. 5 is a perspective view illustrating a hair clip according to prior art.

Referring to FIGS. 2 to 4, in use, the user may laterally open the first and second clip pieces 1 and 2 by means of pivoting about the hinge portions 12 and 22, which are opened at a larger angle when compared to a conventional design. The opened hair clip is put to the area of hair to be clipped, and then is closed by pivoting in a reverse direction. As shown in FIG. 3, the first and second clipping ends 131 and 231 engage with each other, thereby providing a secure clipping effect. Referring to FIG. 4, it is appreciated that upper portions of the clip pieces 1 and 2 need not to be pressed, while the decoration portions 14 and 24 are exposed to increase the decoration effect. Furthermore, no spring is used, i.e., the hair clip of the present invention can be used longer when compared with the conventional design.

Although the invention has been explained in relation to its preferred embodiment, it is to be understood that many other possible modifications and variations can be made without departing from the spirit and scope of the invention as hereinafter claimed.

What is claimed is:

1. A hair clip comprising:

a first clip piece and a second clip piece which are made from flexible material and complimentarily formed, each of the first and second clip pieces including a medial portion and an inclined teeth-like concavely curved clipping portion formed at a bottom of the medial portion, each said inclined clipping portion including a plurality of teeth which are disposed outwardly relative the medial portion and so spaced and dimensioned as to allow smooth lateral opening and closing of the two clipping portions outwardly relative to the medial portion without jamming of hair between the teeth of the clipping portions, the first clip piece having a first end and a second end, the second end of the first clip piece having a first clip member with a first clipping end formed thereon, the second clip piece having a first end pivotally connected to the first end of the first clip piece, and the second end of the second clip piece having a second clip member with a second clipping end formed thereon, the first clipping end and th second clipping end having different extending directions and being engaged releasably together when the two clipping portions are in an engaged position.

2. The hair clip according to claim 1, wherein each of the first and second clip pieces includes a decoration portion which is exposed when the hair clip is used on a hair of a user.

* * * * *